United States Patent [19]

Kendall-Tobias

[11] Patent Number: 4,568,267

[45] Date of Patent: Feb. 4, 1986

[54] SAFETY APPARATUS FOR AN ATOMIC ABSORPTION SPECTROPHOTOMETER BURNER

[75] Inventor: Michael W. Kendall-Tobias, Danbury, Conn.

[73] Assignee: The Perkin-Elmer Corporation, Norwalk, Conn.

[21] Appl. No.: 670,711

[22] Filed: Nov. 13, 1984

[51] Int. Cl.[4] ..... F23N 1/02

[52] U.S. Cl. ..... 431/90; 356/315; 356/417

[58] Field of Search ..... 422/91; 431/90; 356/315, 417

[56] References Cited

U.S. PATENT DOCUMENTS 3,299,940 1/1967 Phillips et al. ..... 431/90

*Primary Examiner*—Carroll B. Dority, Jr.

*Attorney, Agent, or Firm*—E. T. Grimes; F. L. Masselle

[57] ABSTRACT

An automatic gas flow safety device or system is provided for use with an atomic absorption spectrophotometer burner. Generally speaking, a dual function pneumatic and electrical safety device is described which provides for a cut-off of the (acetylene) gas to the burner, upon monitoring an unacceptable air flow or electrical condition, to avert possible flash-backs at the burner. The invention basically comprises a pneumatic and electrical actuated means to control the on/off flow of gas to the burner determinative on the status of the air pressure and electrical power to the system.

6 Claims, 2 Drawing Figures

SAFETY APPARATUS FOR AN ATOMIC ABSORPTION SPECTROPHOTOMETER BURNER

FIELD OF THE INVENTION

The invention pertains generally to atomic absorption spectrophotometers, and more particularly, to an automatic safety valve system for burners used in atomic absorption spectrophotometer.

BACKGROUND OF THE INVENTION

Various prior art burner safety and air control systems have been proposed in the prior art.

Typically, these systems are relatively complex and expensive, and utilize sumptuous components such as: a discrete electrically actuated monitoring air pressure sensor(s) for producing electrical control signals, for example, to a responsive valve means, a discrete electrical power failure sensor for providing a control signal and elaborate electrical drive circuitry.

A few prior art patents of general interest includes U.S. Pat. Nos. 4,220,413 issued Sept. 2, 1980 to Roger W. Targowski et al; 3,801,282 issued Apr. 2, 1974 to David C. Manning et al; 3,708,228 issued Jan. 2, 1973 to H. Trevor Delves and 3,361,925 issued Jan. 2, 1968 to J.W. Vollmer.

These patents are mentioned as being representative of the prior art and other pertinent patents/references may exist. None of the above cited patents are deemed to affect the patentability of the present claimed invention.

In contrast to the prior art, the present invention provides a safety system having a simple, robust and relatively inexpensive structure which combines the dual function of air pressure and power failure safety capabilities in a somewhat integrated manner and involves a minimum of readily available associated parts.

SUMMARY OF THE INVENTION

Generally speaking, in accordance with the invention, an automatic safety system is provided primarily to prevent flash-backs at the burner of an atomic absorption spectrophotometer. The system permits continuous flow of the acetylene gas to the burner subject to a minimum air pressure being monitored, and a cutoff of acetylene gas to the burner with detection of an air pressure below the minimum pressure. The invention (embodiment) comprises an in-line on/off fuel control valve actuated by a pneumatic valve actuator means and an electrical solenoid valve having a normally closed (not energized) state coupled, without obstruction of the air flow to the burner, between the air source and the pneumatic valve actuator means for coupling the pressurized air to the actuating input; of the pneumatic valve actuator means with the electrical power applied to the solenoid valve being adequate to energize it to an open state.

Accordingly, it is an object of the present invention to provide a relatively inexpensive safety system for the burner of an atomic absorption spectrophotometer.

Another object of the present invention is to provide a relatively simple, robust and reliable safety mechanism for burners.

Another object of the present invention is to provide an on/off fuel control device which is responsive to air pressure.

Another object of the present invention is to provide an on/off fuel control device for an atomic absorption spectrophotometer burner which is responsive to air pressure while not having an in-line obstruction between the air source and the burner.

Still another object of the invention resides in the provision of a safety system which is sensitive to failure of electrical power to the system.

Yet another object of the present invention is to provide an on/off fuel control system which utilizes readily available relatively inexpensive component parts.

BRIEF DESCRIPTION OF THE DRAWINGS

Other objects and advantages of this invention may be seen more clearly from the following description when viewed in conjunction with the accompanying drawings.

DESCRIPTION OF THE PREFERRED EMBODIMENT

The following detailed description is of the best presently contemplated embodiment of carrying out the invention. This description is not to be taken in a limiting sense, but is made merely for the purpose of illustrating the general principles of the invention since the scope of the invention is best defined by the appended claims.

Figure 1:
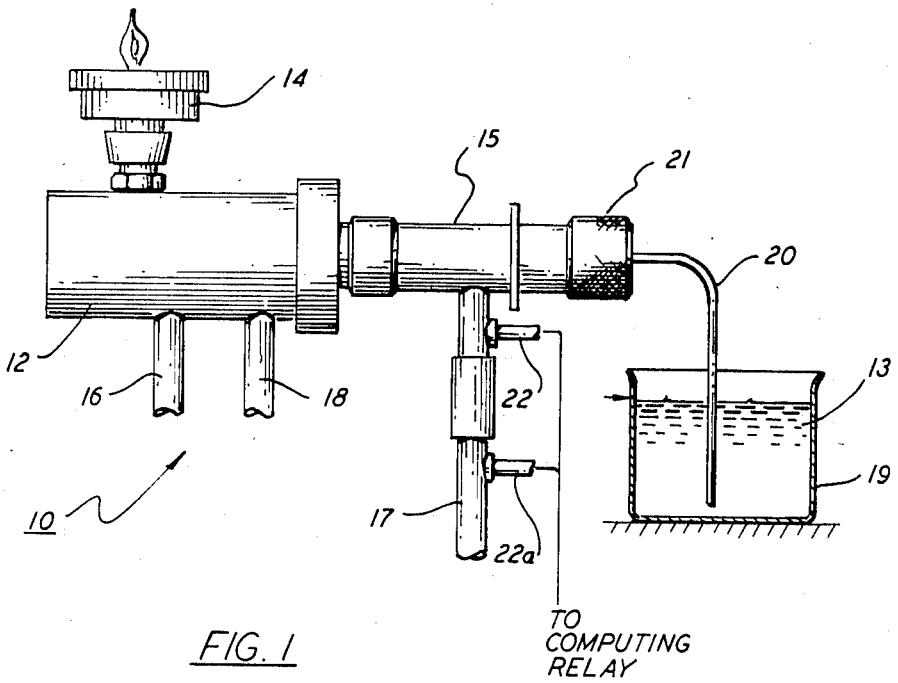
FIG. 1 is an elevational view of a nebulizer-burner assembly as typically employed in atomic absorption spectrophotometer instrumentation.

Referring to FIG. 1, there is shown a typical nebulizer-burner assembly 10 as used in atomic absorption spectrophotometer. The nebulizer-burner assembly 10 generally includes a chamber 12 for mixing acetylene, air and an unknown element-containing sample 13, a burner 14, a nebulizer 15, a fuel line 16, and an air line 17, and an auxiliary air line 18.

Since the details of the nebulizer-burner assembly 10 does not form a part of the invention and conventional means can be used, exhaustive details thereof are omitted to avoid prolixity.

Briefly stated, the burner fuel, acetylene, is supplied to the system via fuel line 16. The fuel is mixed within chamber 12 with air and the unknown element-containing sample, which mixture is directed to the burner. Once ignited, the subsequent burning of the mixture is carried out for producing the telltale element flame characteristics. The sample solution 13, in conventional manner, is contained in a beaker 19. The aspirating action of a venturi-type restriction in the nebulizer draws solution out of the beaker through capillary-like tubing 20. The aspiration of the sample is achieved by the rapidly moving gas which draws the solution in the nebulizer and atomizes it into a fine spray. The rapidly moving gas enters the nebulizer via air line 17. The auxiliary inlet line 18 to the burner may be adapted (not shown) to enable fine tuning adjustment to the air flow to compensate for the last adjustment to the nebulizer via knob 21. This adjustment may be effected automatically via ports 22 and **22*a*** being directed to a so-called "computing relay" as more fully described in U.S. Pat. No. 4,220,413.

Figure 2:
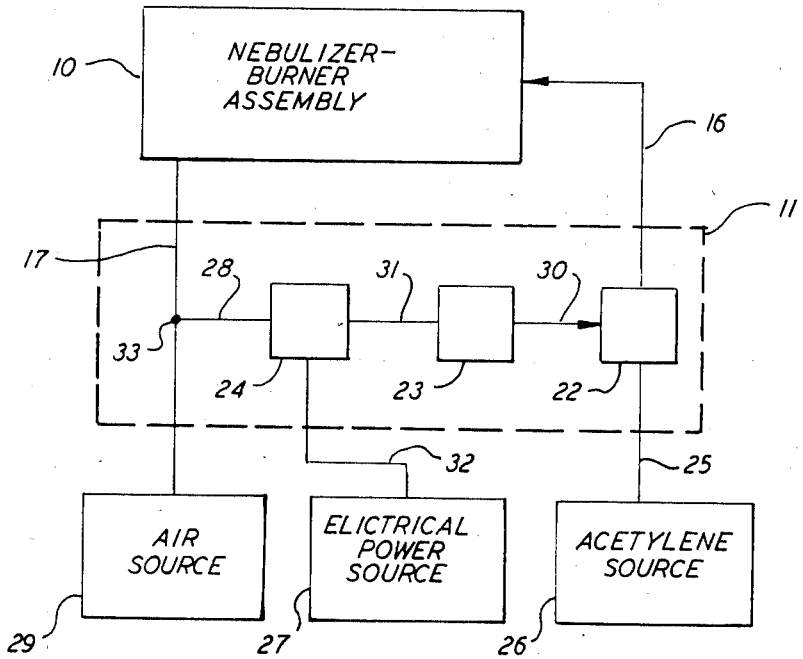
FIG. 2 is a block diagram of the automatic gas flow safety system in accordance with the invention.

With reference now to FIG. 2, there is shown in block diagram form, the automatic gas flow safety system 11 in accordance with the invention. The automatic gas flow safety system 11 comprises a miniature control valve 22, a valve actuator 23 and a solenoid valve 24 interconnected and coupled between the acetylene line 16 and the air line 17 to form an on/off safety valve between the acetylene line 16 and the acetylene source 26. In a few situations the reference numerals in FIGS. 1 and 2 are identical to identify the same components or tubing-lines even though in FIG. 2 they are illustrated as a block diagram equivalent.

Control valve 22 has an inlet and an outlet port (not shown) which are connected in-line between acetylene line 16 and acetylene source line 25. Acetylene source line 25 couples the outlet of the acetylene tank 26 to the inlet of control valve 22. The line 16 couples the outlet of control valve 22 to the acetylene input port of mixing chamber 12 of the nebulizer-burner assembly 10. Control valve 22 is a normally closed type valve which is actuated to its open state by means of a stem actuator (not shown) being depressed. When in the closed state, control valve 22 effects a cutoff of the acetylene gas flow to fuel line 16 and mixing chamber 12. When in the open state, control valve 22 enables the flow of acetylene gas from tank 26 to the mixing chamber 12 via fuel lines 16 and 25.

Valve actuator 23 is connected to control valve 22 by conventional means with the stem actuator of control valve 22 being operatively engaged as indicated at 30 by valve actuator 23. With air pressure between 23–250 psi being applied to the input port (not shown) of valve actuator 23, via tubing 31, the stem actuator of control valve 22 is depressed, overcoming the resistance of a control spring thereby actuating control valve 22 to its open state.

On the other hand, if the air pressure being applied to the input port of valve actuator 23 falls below approximately 14 psi, the spring in valve actuator 23 is decompressed which enables the stem actuator of control valve 22 to return to its deactivated position such that control valve 22 is switched to its normally closed state. As noted above, in the closed state, control valve 22 cutoff the gas flow to the nebulizer-burner assembly 10.

Solenoid valve 24 is operatively coupled between air line 17 and valve actuator 23 via tubing 28 and 31, and is electrically connected via lead 32 to a source of electrical power 27. Tubing 28 is connected at one end to the inlet port (not shown) of solenoid valve 24 and at its other end to tubing 17. Tubing 31 is connected at one end to the outlet port of solenoid valve 24 and at its other end to the inlet port of valve actuator 23. Solenoid valve 24 is a normally closed type valve which is actuated to its open state when electrically energized via lead 32 by power source 27. It is noted that the connection at 33 between tubing 17 and 28 is, for example, a "T" or "Y" type connection to prevent or avoid obstruction in tubing or line 17. In this manner, a non-obstructed air flow path between air source 29 and nebulizer-burner assembly 10 is effected.

Control valve 22, valve actuator 23 and solenoid valve 24 may be of conventional design such as an MAV-2 type valve, an MPA-3 pilot actuator and an EV-3 solenoid each available from Clippard Instrument Laboratory, Inc., Cincinnati, Ohio. The operational specifications are available in published bulletin provided by Clippard Instrument Laboratory, Inc.

OPERATION

The system operation will now be discussed first assuming a start-up condition.

With electrical power being applied to solenoid valve 24 via power source 27 and lead 32, solenoid valve 24 is placed in an open state. As the air 29 and acetylene 26 tanks are turned on, the acetylene is initially blocked by control valve 22 being in a closed state. The air is coupled via tubing 17 to the nebulizer-burner assembly 10, and via tubing 28 through the now open solenoid valve 24 and tubing 31 to the input port of valve actuator 23. With the air pressure attaining approximately 23 psi or greater, valve actuator 23 is pneumatically actuated causing the valve stem of control valve 22 to be depressed. As noted above, depression of the valve stem causes control valve 22 to be switched to its open state. In the open state, the acetylene gas is permitted to flow from tank 26 through tubing 25, control valve 22 and tubing 16 to the nebulizer-burner assembly 10. The burner 14 may then be operated in normal manner.

It should be noted at this time that should the air pressure fall to a pressure of approximately 10 psi or below, the burner flame may have a tendency to follow the air below the burner head which may result in flashbacks. This possibility is substantially reduced by the present system 11 in the following manner.

As the air pressure falls to approximately 14 psi, the valve actuator 23 is deactivated causing the valve stem of control valve 22, which is under spring bias outwardly, to travel to its outward position thereby switching control valve 22 to its closed state. With control valve 22 in a closed state, the flow of acetylene fuel to the nebulizer-burner assembly 10 is cutoff, which thereby reduces or eliminates the possibility of flashbacks.

Another condition which is safeguarded against by the present invention is the failure of electrical power to system 11. A power failure deenergizes solenoid valve 24 causing it to switch or revert to its normally closed state. When in its closed state, the exhaust port (not shown) of solenoid valve 24 is opened or connected with its outlet port. This reduces the air pressure at the inlet port of valve actuator 23 to atmospheric. With atmospheric pressure being applied to its inlet port, valve actuator 23 is, in effect, deenergized which enables the valve stem of control valve 22 to return to its outward most position. At this outward valve stem position, the control valve 22 is switched to its normally closed state and, thereby, causing cutoff of acetylene to the nebulizer-burner assembly 10.

As should be readily seen, in both the above described operating conditions, the acetylene fuel is cutoff while the air flow to the nebulizer-burner assembly 10 is not obstructed by system 11.

What is claimed is:

1. A safety system for an atomic absorption spectrophotometer having a burner, and having means for supplying acetylene, and having means for supplying air to the burner comprising:

first means having a first operative state to enable acetylene flow from the acetylene supplying means to the burner, and having a second operative state to effect a substantial cutoff of the flow of acetylene from the acetylene supplying means to the burner;

second means responsive to a first air pressure level of the air flow to the burner from the means supplying air for actuating said first means into said first operative state, and responsive to a second air pressure level of the air flow to the burner from the means supplying air for actuating said first means into said second operative state; and third means operatively coupled to said second means and being responsive to an electrical power failure for effecting an air pressure level at said second means equal to or less than said second air pressure level whereby said second means actuates said first means into said second operative state.

2. A safety system as in claim 1, wherein:

the first means comprises a discrete gas flow control valve having an inlet port connected with a conduit to the means for supplying acetylene, and having an outlet port connected with a conduit to an acetylene input port of the burner, said gas flow control valve having an actuator stem means being actuatable to a first position whereby the first operative state is maintained and being actuatable to a second position whereby the second operative state is maintained.

3. A safety system as in claim 1, wherein:

the second means comprises a discrete valve actuator being pneumatically actuatable for mechanically actuating said first means.

4. A safety system as in claim 1, wherein:

the third means comprises a solenoid valve having a gas inlet port connected with a conduit to the means for supplying air, and having an outlet port connected via a conduit to a gas inlet port of said second means, and having an electrical lead connected to a source of electrical power, said solenoid valve being electrically energizable whereby the air pressure level at said gas inlet port is transmitted to said second means, said solenoid valve being deenergizable with detection of a power failure whereby the air pressure at said gas inlet port is cutoff from said second means and said second air pressure level is transmitted to said second means via an exhaust port of said solenoid valve.

5. A safety system as in claim 1, wherein:

the first means comprises a normally closed valve mechanism having an inlet port, an outlet port and an actuator stem, said inlet port being coupled to the means for supplying acetylene, said outlet port being coupled to the burner, and said actuator stem being actuatably movable for causing said valve mechanism to switch from a normally closed state to an open state and from an open state to a closed state; and the second means comprises an actuator mechanism being affixed to said valve mechanism, said actuator mechanism having a gas inlet port operatively connected to the means for supplying air and having means in operative engagement with the actuator stem of said valve mechanism, said actuator mechanism being responsive to a gas pressure at said gas inlet port of approximately 23 pounds per square inch or greater for actuatably moving said actuator stem whereby said valve mechanism is placed in the open state and being responsive to the gas pressure at said gas inlet port falling to or below a gas pressure of approximately 14 pounds per square inch for effecting said actuator stem movement whereby said valve mechanism is returned to the closed state.

6. An automatic gas flow safety apparatus for an atomic absorption spectrophotometer system having a burner and mixing chamber, and having means for supplying acetylene to the mixing chamber, and having means for supplying air to the mixing chamber comprising:

a flow control valve means connected in-line between the means for supplying acetylene and the mixing chamber, and having a closed condition for blocking the flow of acetylene to the mixing chamber, and having an open condition for permitting the flow of acetylene to the mixing chamber; and actuator means operatively connected with said flow control valve means and being responsive to a first predetermined air pressure to the mixing chamber for causing said flow control valve means to operate in said open state to enable acetylene flow to the mixing chamber, and being responsive to a second predetemined air pressure to the mixing chamber for effecting cutoff of acetylene flow to the mixing chamber, a solenoid valve means operatively connected with the means for supplying air and with said actuator means, said solenoid valve means having normally closed state and a open state, said solenoid valve means being electrically enegizable to the open state for coupling air being provided by said means for supplying air to said actuator means, said solenoid valve means being returned to the normally closed state with detection of a power failure to cutoff the air flow between said actuation means and the means for supplying air.

* * * * *